US005557897A

United States Patent [19]

Kranz et al.

[11] Patent Number: 5,557,897

[45] Date of Patent: Sep. 24, 1996

[54] FASTENING DEVICE FOR A ROOF SEALING STRIP OR THE LIKE

[75] Inventors: Klaus Kranz, Weisbaden; Reinhard Schubert, Hemsbach, both of Germany

[73] Assignee: BRAAS GmbH, Frankfurter, Germany

[21] Appl. No.: 284,536

[22] PCT Filed: Feb. 11, 1993

[86] PCT No.: PCT/DE93/00132

§ 371 Date: Nov. 21, 1994

§ 102(e) Date: Nov. 21, 1994

[87] PCT Pub. No.: WO93/17200

PCT Pub. Date: Sep. 2, 1993

[30] Foreign Application Priority Data

Feb. 20, 1992 [DE] Germany ..... 42 05 140.1

[51] Int. Cl.[6] ..... E04D 5/14

[52] U.S. Cl. ..... 52/410; 411/372; 411/373; 411/396; 411/533

[58] Field of Search ..... 52/408, 410, 483.1; 411/372, 373, 396, 533

[56] References Cited

U.S. PATENT DOCUMENTS

| | | | |
|---|---|---|---|
| 4,726,164 | 2/1988 | Reinwall et al. | 411/533 X |
| 4,757,661 | 7/1988 | Hassan | 411/533 X |
| 4,780,039 | 10/1988 | Hartman | 411/533 X |
| 4,809,477 | 3/1989 | Gasser . | |
| 4,860,513 | 8/1989 | Whitman . | |
| 4,900,208 | 2/1990 | Kaiser et al. | 52/410 X |
| 4,978,350 | 12/1990 | Wagenknecht . | |
| 4,999,963 | 3/1991 | Verbue | 52/410 |

FOREIGN PATENT DOCUMENTS

| | | | |
|---|---|---|---|
| 0412382 | 2/1991 | European Pat. Off. . | |
| 2492480 | 4/1982 | France . | |
| 2515713 | 5/1983 | France . | |
| 1292356 | 3/1962 | Germany . | |
| 2622395 | 3/1976 | Germany . | |
| 2611395 | 3/1976 | Germany . | |
| 4040135 | 12/1990 | Germany . | |
| 4128033 | 8/1991 | Germany . | |
| 2015634 | 9/1979 | United Kingdom . | |
| 8001491 | 7/1980 | WIPO | 52/512 |

*Primary Examiner*—Carl D. Friedman
*Assistant Examiner*—Yvonne Horton-Richardson
*Attorney, Agent, or Firm*—Loeb & Loeb LLP

[57] ABSTRACT

A fastening device for anchoring a sealing strip on a roof includes an elongated fastener which penetrates both a holder and the sealing strip and has a drill tip at a lower end thereof extending into the roof substructure. An opposite upper end of the fastener has an enlarged upper end engaged in an opening in the holder to press the holder against and anchor the sealing strip on the roof. A cover having a recessed underside for receiving the holder and a central hole with a slit-like depression for receiving a catch-shaped projection extending upwardly from the head of the fastener is rotated to drive the fastener and the holder into position on the sealing strip while at the same time covering the opening in the holder to prevent entry of rainwater and the like. As the cover engages the sealing strip, the cover eventually disengages the fastener so that only the cover rotates. Continued rotation of the cover causes friction between the cover and the sealing strip to heat and thereby friction weld the fastening device to the sealing strip.

8 Claims, 4 Drawing Sheets

FASTENING DEVICE FOR A ROOF SEALING STRIP OR THE LIKE

BACKGROUND OF THE INVENTION

1. Field of the Invention

The present invention relates to fastening devices for anchoring a sealing strip on a roof, and more particularly to fastening devices for a roof sealing strip in which a fastener penetrates a holder in the sealing strip so that the holder is pressed against the upper side of the sealing strip to anchor it on a roof.

2. Description of the Prior Art

Sealing strips, especially sealing strips placed on a flat roof and made of polyisobutylenes, polyvinyl chloride, bitumen, polymer bitumen or the like, must be fixed to the structure by means of mechanical fasteners in order to prevent being lifted by the wind. At least three fastening devices need to be provided per square meter of roof top in the center region of a building roof, more than ten in the corner region, and an inbetween quantity in the edge region.

The fastening devices are usually arranged in the edge region of a roof sealing strip and are tightly covered by the adjacent roof sealing strip, with a seam overlap of 10 cm to 12 cm being provided. Seam overlaps, especially roof sealing strips made of plastic, are a significant cost factor.

Since the fastening devices in a region must be distributed approximately evenly over the roof top, narrower roof sealing strips are placed in regions requiring a larger quantity of fastening devices, i.e., in corner and edge regions, than in the center region of a roof. The fastening devices are thus arranged parallel to the rows to be fastened extending along the edges of a roof sealing strip. Within certain limits, the distance between the fastening devices in a row to be fastened should correspond to the quantity of fastening devices required per square meter. A distance greater than 50 cm and a distance of less than 15 cm must be avoided in this case. The requirement to match different strip widths continues to be a relatively complicated problem to solve in practice.

The introduction of load in the covered edge region of mechanically fastened roof sealing strips is statically disadvantageous, since the introduction of load is asymmetric and thus requires additional efforts to secure them.

In order to eliminate these drawbacks, fastening devices were developed which may be installed at any desired location in a roof sealing strip. Fastening devices which penetrate the roof sealing strip (through strip fasteners) have proven to be successful.

U.S. Pat. No. 4,860,513 discloses such a fastening device for roof sealing strips comprising a disk-shaped holder and a through-opening arranged in the center. The wall of the through-opening is configured semi-circularly concave toward the udder side in order to receive the head of a screw which is semi-circular on its underside and serves as a fastener. On its upper side the head of the screw is provided with a hexagon socket. Due to the semi-circular fit of the screw head in the holder, the screw must be attached pivotably and perpendicularly in relation to the roof top. The head of the screw lies approximately on the plane of the roof sealing strip, so that in the region of the threaded joint, a relatively large hole must be punched out of the roof sealing strip. The screw, which is provided as a fastener has a hollow shaft, and in the region of the screw thread, bores, penetrating the walls of the fastener in the radial direction, are provided at the lower end of the fastener such that a sealing means may be pressed from the upper end of the fastener through the hollow shaft. However, in the known fastening device no seal is provided between the head of the fastening means and the holder.

SUMMARY OF THE INVENTION

It is the object of the present invention to configure a fastening device of the type discussed such that, while having a simple form and being easy to assemble, a safe cover is provided for the hole required for the penetration of the fastener into the sealing strip.

This object is attained in that a cover grips over the holder in the manner of a cap; a torque transmission device is arranged at the upper side of the cover to whose underside a coupling is attached, which is in a longitudinally displaceable engagement with the upper end of the fastener and which connects the fastener to the cover, secured against rotation, only in the region of the upper end position of the fastener; and the free edge of the cover is tightly connected with the sealing strip lying below.

To assemble the fastening device according to the invention, the fastener, preferably a drilling screw, is inserted through the holder, and the head of the fastener is subsequently inserted into the coupling on the underside of the cover. In this state, the fastening device may be affixed to the upper side of the roof sealing strip by means of a rotating positioning device which makes contact with the outer surface of the cover. The axis of the fastener in this case is aligned at right angles to the upper side of the roof sealing strip. Transmission of torque from the positioning device to the cover may be accomplished, for example, by means of taps on the positioning device and blind holes in the upper side of the cover, or by means of a hexagon socket in the positioning device and a hexagon head in the center of the cover.

Due to the rotation of the positioning device, the fastener which is connected with the cover so as to be secured against rotation penetrates through the roof sealing strip and through an insulating layer, which may be part of the roof structure, into the substructure which is frequently in the form of a metal sheet with trapezoidal corrugations. The drilling tip of a drilling screw used as a fastener may penetrate the metal sheet with trapezoidal corrugations and may subsequently anchor itself with its thread into the substructure. In this case, the fastener becomes tightened in the direction of the substructure and presses the holder against the upper side of the sealing strip. As soon as the free edge of the cover contacts the upper side of the roof sealing strip, the cover no longer follows the movement of the fastener in the axial direction, so that the fastener leaves the end position of the cover and after a few rotations is no longer connected with the latter so as to be secured against rotation.

The coupling of the cover is advantageously configured as a blind hole whose wall is profiled similar to the upper end of the fastener so as to be suitable for transmitting torque. The blind hole is preferably provided at its bottom with a slit-like depression, and the upper end of the fastener with a catch-shaped projection that engages the latter. If the fastener has a hexagon head, the wall of the blind hole may be configured as a hexagon socket. And, vice versa, the coupling may also be configured such that a catch-shaped projection at the bottom of the blind hole in the cover engages a slit in the head of the fastener.

Since assembly conditions on a roof do not always ensure that the axis of the fastener is adjusted at a right angle to the upper side of the roof, the fastener is pivotable in relation to the plane of the holder. In order to accomplish this, it is advantageous if the fastener is provided at its upper end with a head having a dome-shaped underside, and if the opening which accommodates the fastener in the holder is surrounded by a depression shaped like a ball socket.

Assembly of the fastening device is facilitated if the holder is detachably connected with the underside of the cover. To accomplish this, it is proposed to provide a plurality of detent projections on the underside of the cap-shaped cover or one sole annular detent projection which the holder can engage. During assembly, the holder engages the cover by means of the penetrating fastener. As soon as the cover contacts the roof sealing strip, the holder disengages itself from the cover and is pressed securely to the surface of the roof sealing strip by a further axial movement of the fastener. In the assembled state, the cover is no longer connected with the holder, such that the seal for the cover on the roof sealing strip is not influenced by forces affecting the holder.

The cover preferably consists of impact-resistant material. The cover may be attached to the roof sealing strip by gluing or solvent welding.

An especially simple assembly of the fastening device is possible if the cover completely, or at least in the region of its edge resting on the sealing strip, is made of a material which may be completely or at least partly bonded by friction welding with the sealing strip.

If this type of cover is used, the use of adhesive and sealing means may be dispensed with. After torque transmission from the cover to the fastener is completed, the cover continues to be rotated for some time by the positioning device such that, in the region of the free edge of the cover, heat is produced which results in the homogenous connection of the cover with the roof sealing strip by means of friction welding.

BRIEF DESCRIPTION OF THE DRAWING

A preferred embodiment of the invention is further explained below and shown in the drawing in which.

DESCRIPTION OF THE PREFERRED EMBODIMENT

Figure 1:
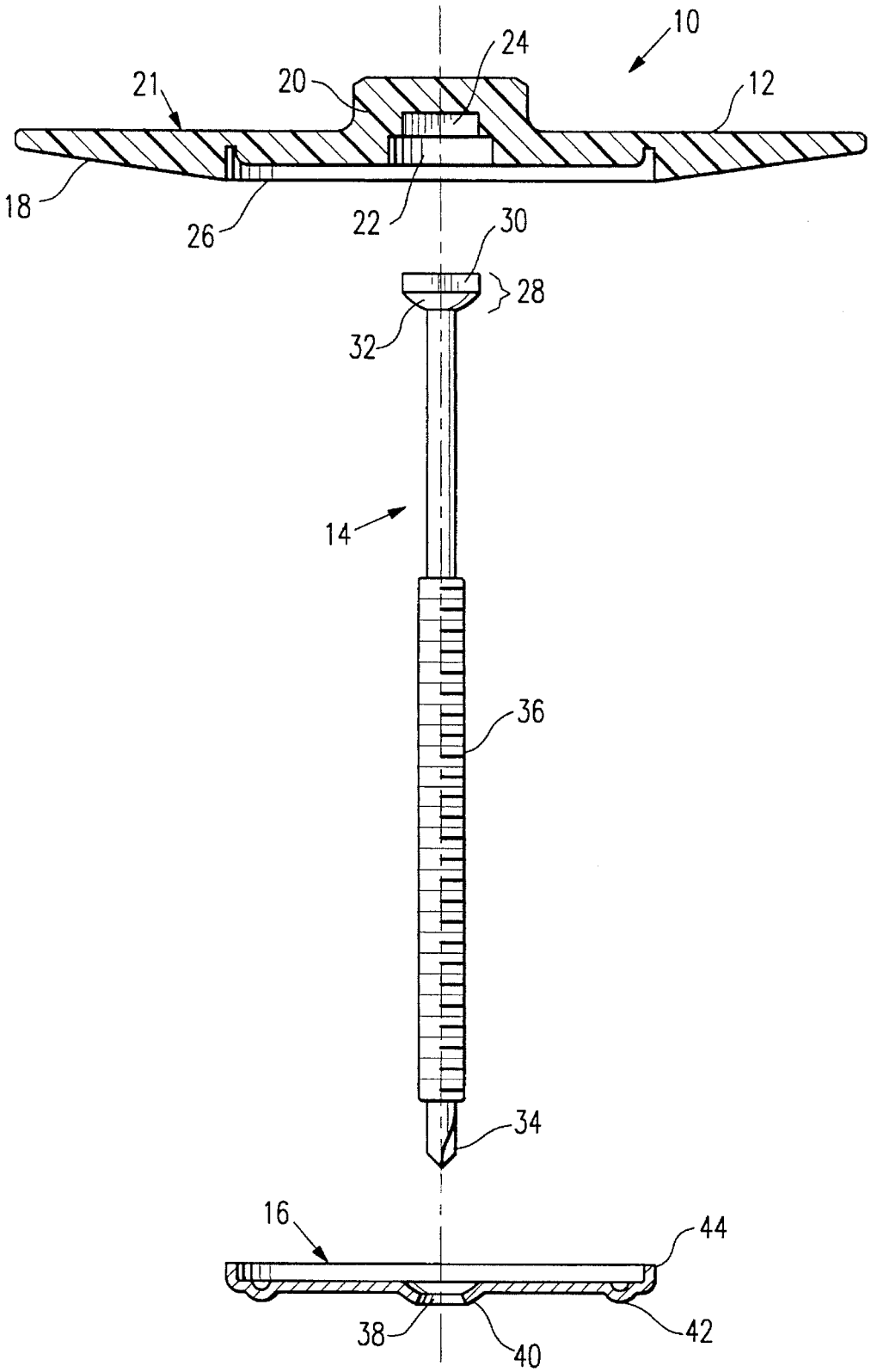
FIG. 1 is a segmented view of a longitudinal section of the fastening device according to the invention, including the individual parts: cover, fastener and holder.
Figure 2:
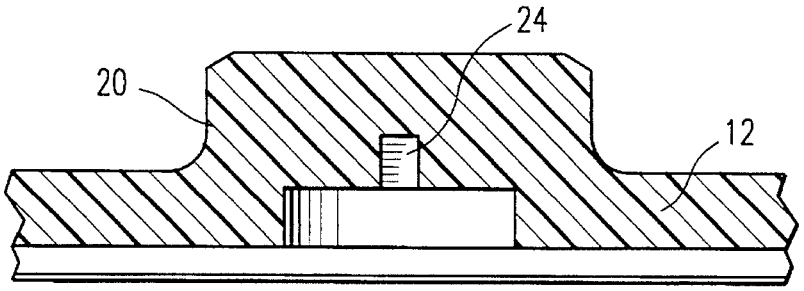
FIG. 2 is a longitudinal section of the center of the cover in FIG. 1, but rotated by 90° by comparison with FIG. 1.

FIG. 1 shows the fastening device 10 including a cap-shaped cover 12, a fastener 14 which is configured as a drill screw and a plate-shaped holder 16. The cover 12 consists of polyvinylchloride (PVC) and is intended for a roof sealing strip made of PVC. The cover 12 is wider in the region of the edge, with the material thickness decreasing toward the outside such that the free edge 18 on the underside of the cover 12 is configured to be slanted toward the outside and to be inclined toward the top. The cover 12 has a diameter of 90 mm and a total height of 11 mm. In the center of the cover 12, a torque transmission device 20 is provided which projects from the otherwise planar upper side 21 of the cover 12. The vertical outer surfaces of the torque transmission device 20 are hexagonal having a spanner width of 17 mm. In the center of the underside 26 of the cover 12, a blind hole 22 having a slit-like depression 24 in its bottom is provided as illustrated in FIG. 2, which shows a longitudinal view of the center of cover 12 which, by comparison with FIG. 1, is rotated by 90°. Below the slit-like depression 24, the blind hole 22 is provided with a round cross section, whose diameter is greater than the length of the slit-like depression 24. Below the blind hole 22, on the underside 26 of the cover 12, a recess 27 is provided whose interior diameter corresponds to the outer diameter of the holder 16.

Figure 3:
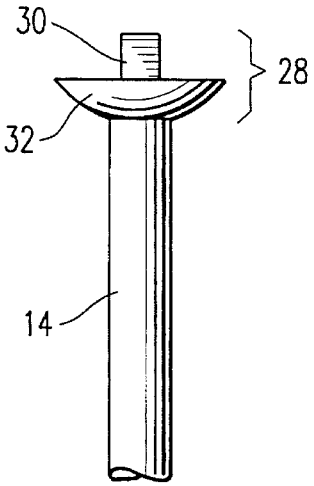
FIG. 3 is a front view of the upper end of the fastener in FIG. 1, but rotated by 90°.

The fastener 14 is configured as a drill screw for a roof and is provided with a catch-shaped projection 30 at its upper end 28, of which FIG. 3 shows a view that is rotated by 90° by comparison to FIG. 1. This projection may be inserted into the slit-like depression 24 in the cover 12. Below the catch-shaped projection 30, the head 32 of the fastener 14 is provided with a round collar whose diameter equals the length of the catch-shaped projection 30. The underside of the head 32 is configured in the shape of a cap. At its lower end, the fastener 14 is provided with a drill tip 34 for penetrating the substructure of the roof. A threaded section 36 is arranged between the drill tip 34 and the upper end 28.

The holder 16 is configured as a round steel disk 40 mm in diameter and having a central opening 38 which is 6.5 mm in diameter. The edge of the disk surrounding the opening 38 is configured as a ball socket-shaped depression 40 and is made to correspond to the underside of the head 32 of the fastener 14. An annular bead 42 which is 32 mm in diameter, extends near the outer edge of the holder 16. The holder 16 is crimped upward at its outer edge 44.

Figure 4:
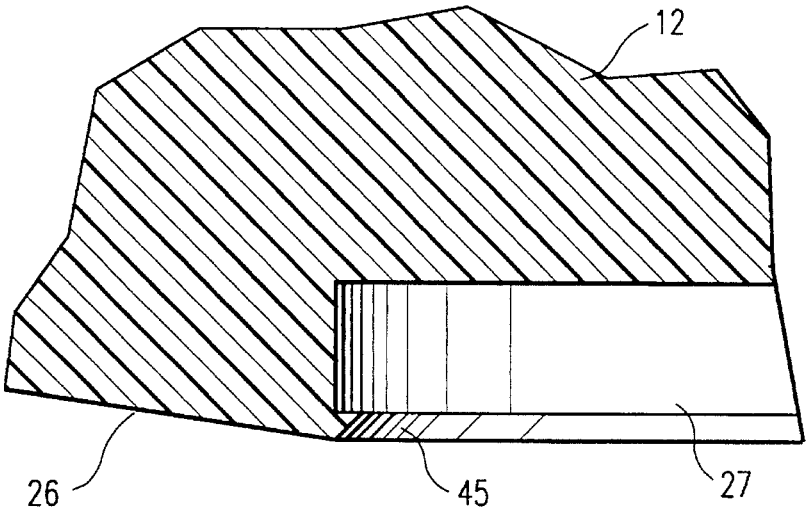
FIG. 4 is the enlarged view of the recess provided at the edge on the underside of the cover and serves to accommodate the holder.

FIG. 4 is an enlargement of the edge of the recess 27 accommodating the holder 16 on the underside 26 of the cover 12. Starting on the underside 26, a triangular detent projection 45 is provided in the recess 27, allowing the holder 16 to be engaged during assembly.

Figure 5:
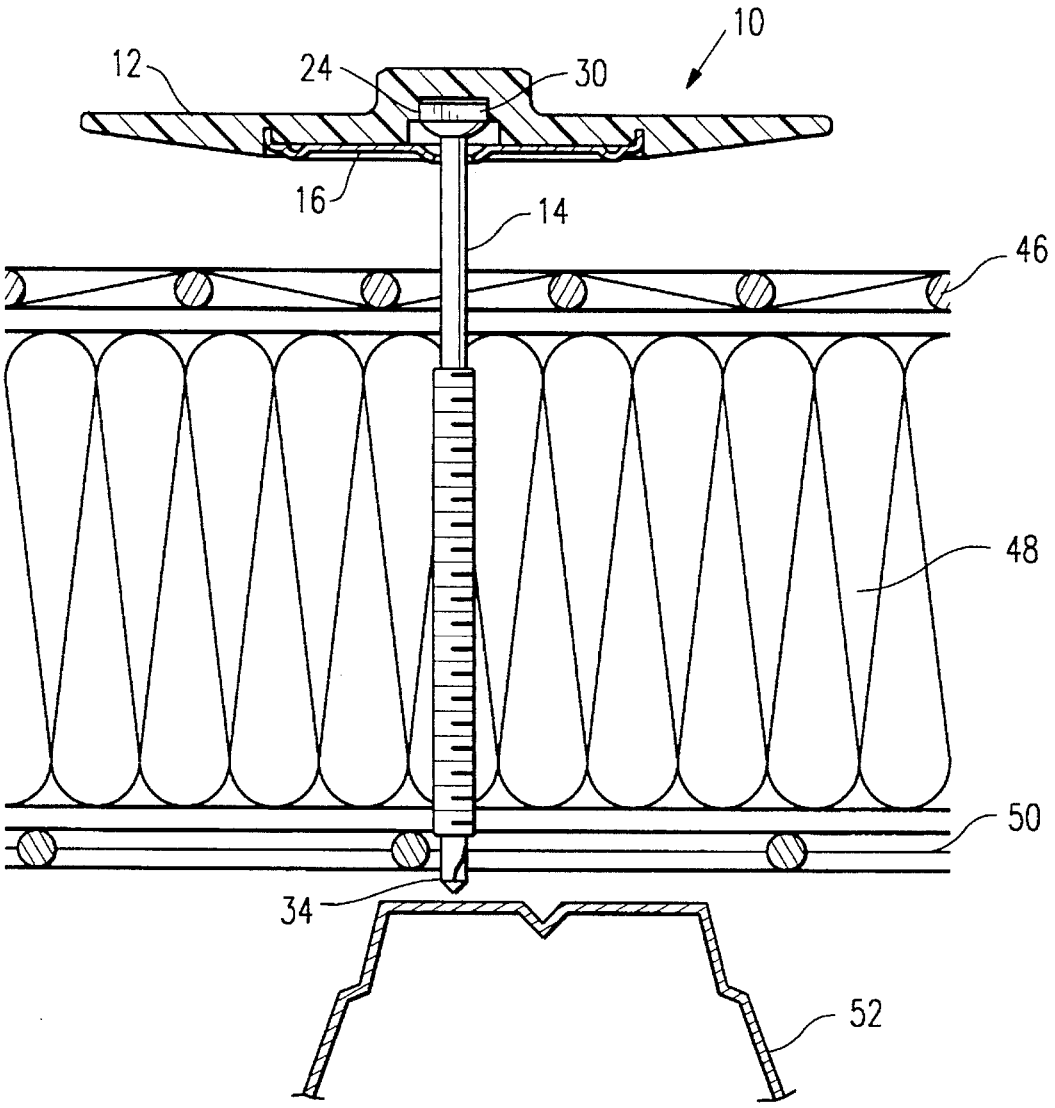
FIG. 5 is the fastening device according to FIG. 1 at the beginning of assembly on a roof.

FIG. 5 shows the fastening device 10 shortly after the start of assembly. The fastener 14 has already penetrated a roof sealing strip 46, an insulating layer 48 and a vapor barrier 50. The drill tip 34 of the fastener 14 sits on the substructure 52, which is a metal sheet having trapezoidal corrugations. The holder 16 is detachably connected with the cover 12 by means of the above-described detent connection. The catch-shaped projection 30 of the fastener 14 is in the slit-like depression 24 of the cover 12, such that a connection which is secured against rotation is established between the cover 12 and the fastener 14.

Figure 6:
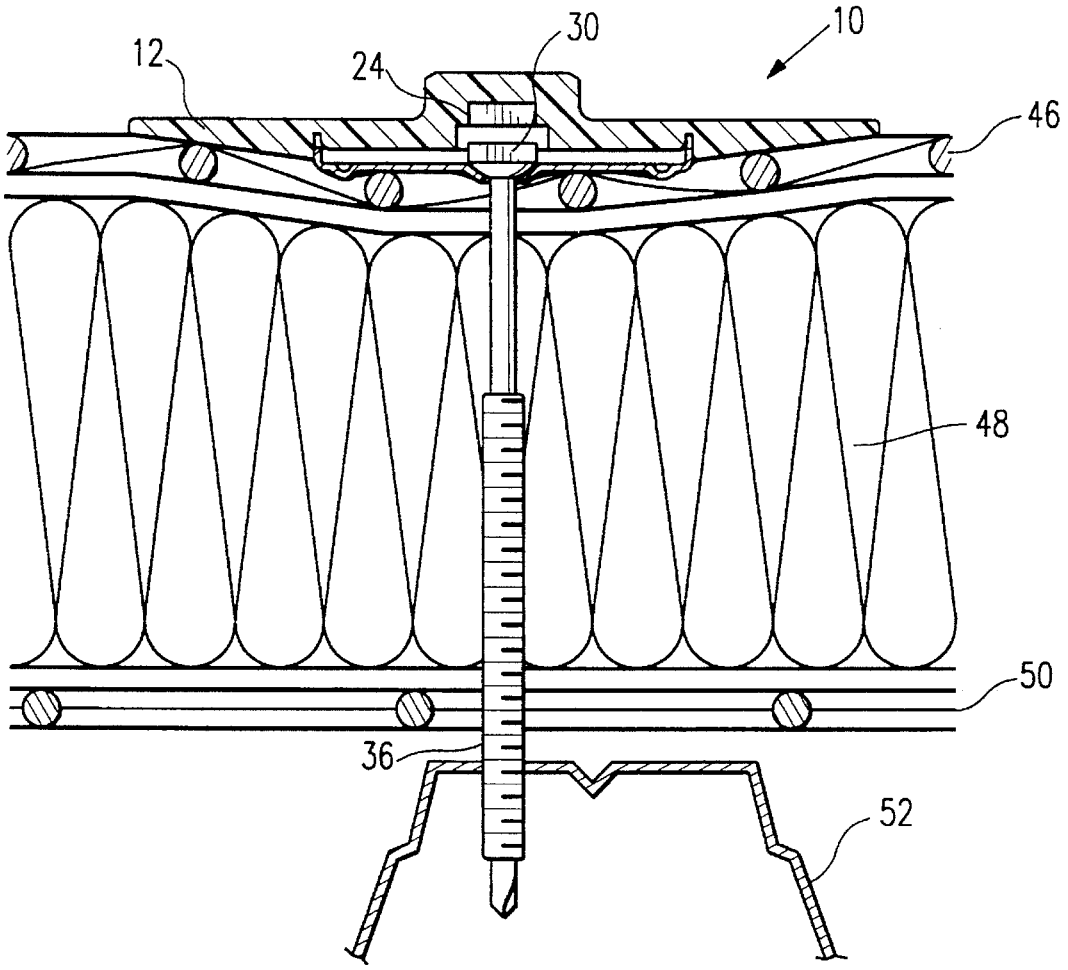
FIG. 6 is the fastening device according to FIG. 1 after assembly is completed.

FIG. 6 shows the fastening device 10 in the assembled state. The fastener 14 is anchored with its threaded section 36 into the substructure 52. The catch-shaped projection 30 of the fastener 14 has disengaged from the slit-shaped depression 24 of the cover 12 downward in the axial direction, such that the cover 12 is freely rotatable about its central axis. The holder 16 is released from the catch connection with the cover 12. An additional rotation of the cover 12 results in friction welding the cover 12 and the roof sealing strip 46 together. In this case, the cover 12 is centrally guided by the head 32 of the fastener 14.

What is claimed is:

1. A fastening device arrangement for anchoring a member on a roof structure comprising:

a holder having a central opening therein;

an elongated fastener for disposition within the central opening in the holder and having a lower end for penetrating a member and a roof structure and an opposite upper end having a head for engagement with the holder at the central opening thereof to press and anchor the member on the roof structure; and a cover having an underside thereof configured to receive the holder and having a central opening therein configured interlockingly to engage the head of the fastener, whereby rotation of the cover rotatably drives the fastener when the central opening therein engages the head of the fastener.

2. A fastening device in accordance with claim 1, wherein the cover extends generally continuously over the holder to cover and protect the central opening in the holder.

3. A fastening device in accordance with claim 1, wherein the head of the fastener has a catch-shaped projection extending upwardly therefrom and the central opening in the holder comprises a blind hole for receiving the head of the fastener and having a slit-like depression extending into the cover therefrom for receiving the catch-shaped projection therein.

4. A fastening device in accordance with claim 3, wherein the catch-shaped projection is longitudinally displaceable from the slit-like depression to selectively engage and disengage the cover from the fastener.

5. A fastening device in accordance with claim 1, wherein the cover has a torque transmission device at an upper side thereof opposite the central opening therein.

6. A fastening device in accordance with claim 1, wherein the head of the fastener has a cap-shaped underside and the holder has a socket-shaped depression for receiving the cap-shaped underside of the head, the central opening being at the bottom of the socket-shaped depression.

7. A fastening device in accordance with claim 1, wherein the underside of the cover which is configured to receive the holder is detachable from the holder.

8. A fastening device in accordance with claim 1, wherein the cover has a free edge at the underside thereof made of material which bonds to the member by friction-welding.

* * * * *